US005530216A

United States Patent [19]

Benke et al.

[11] Patent Number: 5,530,216

[45] Date of Patent: Jun. 25, 1996

[54] FLEXIBLE CONNECTOR FOR A CIRCUIT BREAKER

[75] Inventors: James J. Benke; Nagar J. Patel, both of Pittsburgh, Pa.

[73] Assignee: Eaton Corporation, Cleveland, Ohio

[21] Appl. No.: 400,142

[22] Filed: Mar. 7, 1995

[51] Int. Cl.[6] ..... H01H 33/66

[52] U.S. Cl. ..... 218/118; 200/50.21; 218/140

[58] Field of Search ..... 200/50 AA; 218/118, 218/84, 140; 174/88 R–88 S, 84 R; 361/637

[56] References Cited

U.S. PATENT DOCUMENTS

| | | | |
|---|---|---|---|
| 3,898,407 | 8/1973 | Hodgson | 218/140 |
| 4,144,554 | 3/1979 | Erickson | 218/84 |
| 4,216,359 | 8/1980 | Hruda | 218/118 |
| 4,376,235 | 3/1983 | Millanowicz | 200/50 AA |
| 4,384,179 | 5/1983 | Millanowicz | 200/50 AA |
| 4,587,390 | 5/1986 | Gray | 361/637 |

OTHER PUBLICATIONS

U.S. patent application Ser. No. 08/093,287, Takiishi, filing date Jul. 1993.

*Primary Examiner*—J. R. Scott
*Attorney, Agent, or Firm*—Martin J. Moran

[57] ABSTRACT

An improved flexible connector for a circuit breaker. The flexible connector preferably, comprises a plurality of flexible sheets arranged in a stack. The stack defines an opening having an edge including at least one tab extending inwardly from the edge of the opening. The tabs are adapted to bend so that they make a secure interference fit with a movable contact so that current can flow directly from the movable contact into the flexible connector. A circuit interrupter system is also disclosed.

10 Claims, 3 Drawing Sheets

FLEXIBLE CONNECTOR FOR A CIRCUIT BREAKER

BACKGROUND OF THE INVENTION

This invention relates to an improved flexible connector for a circuit breaker, and more particularly, to a flexible connector that provides a direct connection of each individual flexible connector to the vacuum interrupter stem.

Circuit breakers are useful for controlling and protecting electrical systems, apparatus and networks. A particular type of circuit breaker is a vacuum circuit interrupter apparatus which includes separable main contacts disposed in an insulated housing. Generally, one of the contacts is fixed relative to both the housing and to an external electrical conductor which is interconnected with the circuit to be controlled by the vacuum circuit interrupter. The other main contact is movable and usually comprises a cylindrical stem having the contact at one end thereof enclosed in a vacuum chamber and driving mechanism at the other end thereof external to the vacuum chamber.

Often the electrical interconnection between the circuit to be protected by the circuit interrupter and the movable contact is made on the cylindrical stem. Therefore, a need arises for channelling significant amounts of electrical current from a movable stem to a stationary electrical contact.

There have been several suggested prior art devices for transferring current from a movable contact to a fixed terminal. For example, U.S. Pat. Nos. 4,376,235 and 4,384,179 disclose a stiff flexible connector for a circuit breaker apparatus. A plurality of unitary, stiff, but flexible electrically conducting members are provided. The members are disposed in a horizontal position, but can move vertically due to a pleat in the member.

Commonly owned U.S. patent application Ser. No. 08/093,287 filed Jul. 16, 1993 discloses a flexible connector for connecting a movable contact of an electrical switch to a fixed electrical terminal. The flexible connector is a stack of flexible sheets of a conducting material and is constructed such that it can accommodate the movement of the movable contact.

In the above devices, the flexible connector includes a contact plate having tabs which maintain secure contact with the vacuum interrupter stem. The contact plates sandwich and are interposed between the flexible connectors making surface contact therewith. Thus, current is directed from the stem to the contact plate and then to the flexible connectors. There is no substantial direct contact between the flexible connectors and the stem.

What is needed, therefore, is a flexible connector that is directly in contact with the stem, and which in turn provides advantages over the currently available commercial flexible connectors.

SUMMARY OF THE INVENTION

The invention has met the above-mentioned need. A flexible connector is provided which, preferably, comprises a plurality of flexible sheets arranged in a stack. The stack defines an opening having an edge including at least one tab extending inwardly from the edge of the opening. The tabs are adapted to bend so that they make a secure interference fit with the movable contact so that current can flow directly from the movable contact into the flexible connector.

This invention allows for movement of the connector well beyond the vertical displacement of the vacuum interrupter stem and the sinusoidal movement caused by current travelling through the connector. The invention also provides for increased heat dissipation due the increased surface area exposed to the cooling air, which is created by the additional number of sheets in the stack of each connector and by air gaps (created by spacers) between individual connectors themselves. This allows for higher levels of current to travel through the connectors.

A circuit interrupter system is also provided including a circuit interrupter having a fixed contact and a movable contact, a fixed electrical terminal and a flexible connector for connecting the movable contact to the fixed electrical terminal. The flexible connector is similar to that described above.

BRIEF DESCRIPTION OF THE DRAWINGS

A full understanding of the invention can be gained from the following description of the preferred embodiment when read in conjunction with the accompanying drawings in which.

DETAILED DESCRIPTION

The invention relates to a flexible connector for connecting a movable contact to a fixed electrical terminal. Although the following description relates to a vacuum circuit interrupter system, it will be appreciated that the invention is not so limited and covers any type of flexible connector which carries current from a movable contact to a fixed electrical terminal.

Figure 1:
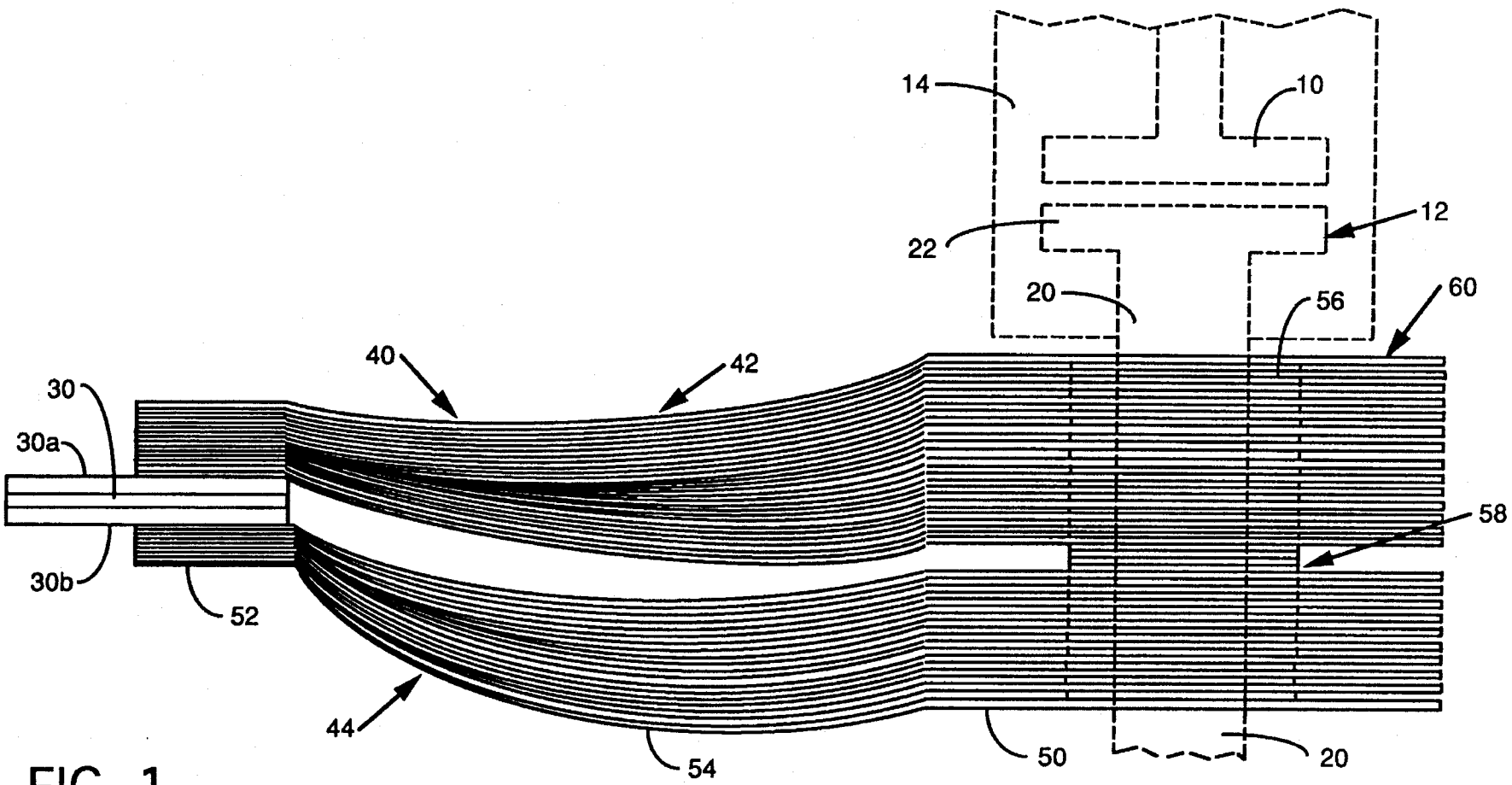
FIG. 1 is a side elevational view showing the flexible connector of the invention connecting the movable contact of a vacuum interrupter with a fixed electrical terminal.

Vacuum interrupter systems are well known in the art and one is described in U.S. Pat. No. 4,384,179 which is expressly incorporated herein by reference. Referring to FIG. 1, these systems include separable main contacts 10 and 12 disposed within insulating vacuum housing 14. One of these contacts 10 is fixed relative to the housing 14 and to an external electrical conductor (not shown) which is interconnected with the circuit to be controlled by the circuit interrupter. On the other hand, the other separable main contact 12 is movable. The movable contact assembly 12 usually comprises a stem 20 of circular cross-section having a contact 22 at one end thereof enclosed within the insulated vacuum housing 14 and a driving mechanism (not shown) at the other end. It can be appreciated, therefore, that significant amounts of electrical current must be channelled from the movable stem 20 to a stationary electrical terminal or contact 30 by the flexible connectors, shown generally as reference number 40.

FIG. 1 shows twenty-four individual flexible connectors in two groups 42, 44, with group 42 including fourteen flexible connectors and group 44 including ten flexible connectors connecting the movable stem 20 to the stationary electrical terminal 30. Each flexible connector has a first rigid portion 50 connected to the movable stem 20, a second rigid portion 52 connected to the stationary electrical terminal 30 and a flexible portion 54 cantilevered between the first rigid portion 50 and the second rigid portion 52. It will be appreciated that the flexible portion 54 allows the movable stem 20 to move axially with respect to the first rigid portion 50 while at the same time having the second rigid portion 52 connected to the terminal 30.

Spacers, such as spacer 56, are interleaved between the first rigid portions of the flexible connectors. These spacers prevent the individual flexible connectors from bonding together to form one monolithic metal connector. This will maintain desired flexibility of the flexible connector on the moving stem 20 end. There are no spacers on the terminal 30 side due to vertical size restrictions. A stack of four spacers 58 are disposed between the two groups 42 and 44 of flexible connectors. The spacers include aligned movable contact openings (not shown) having edges contacting the movable stem 20 so that electric current can also flow from the movable contact through the spacer and into the first rigid portion 50 of the flexible connectors. The second rigid portions of the first group 42 of flexible connectors are sandwiched together and connected to the top surface 30*a* of the terminal 30 and the second rigid portions of the second group 44 of flexible connectors are sandwiched together and connected to the bottom surface 30*b* of the terminal 30.

Figure 2:
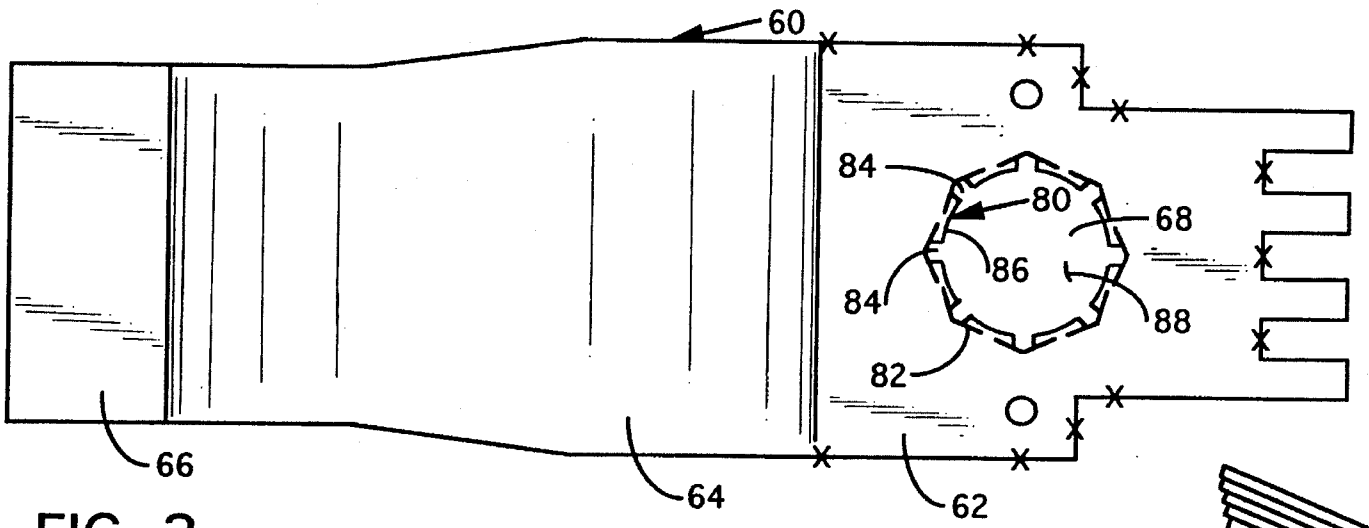
FIG. 2 is a top plan view of a single flexible connector.

Referring now to FIG. 2, an individual flexible connector 60 is shown. The flexible connector 60 is made of a conducting material, preferably copper and is, for this example about twelve inches in length and four inches in width. The flexible connector 60 has a first rigid portion 62, a flexible portion 64 and a second rigid portion 66. The first rigid portion 62 defines an opening 68, which will be discussed in detail hereinbelow, for receiving the movable stem 20.

Figure 4:
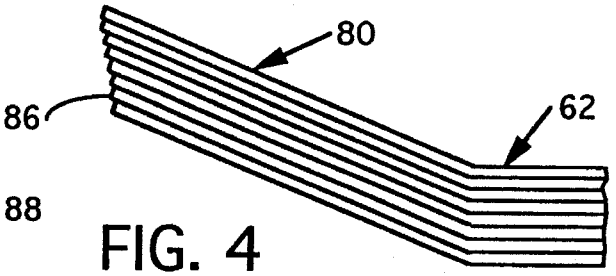
FIG. 4 is an enlarged side elevational view of a portion of the flexible connector shown in FIG. 3.
Figure 3:
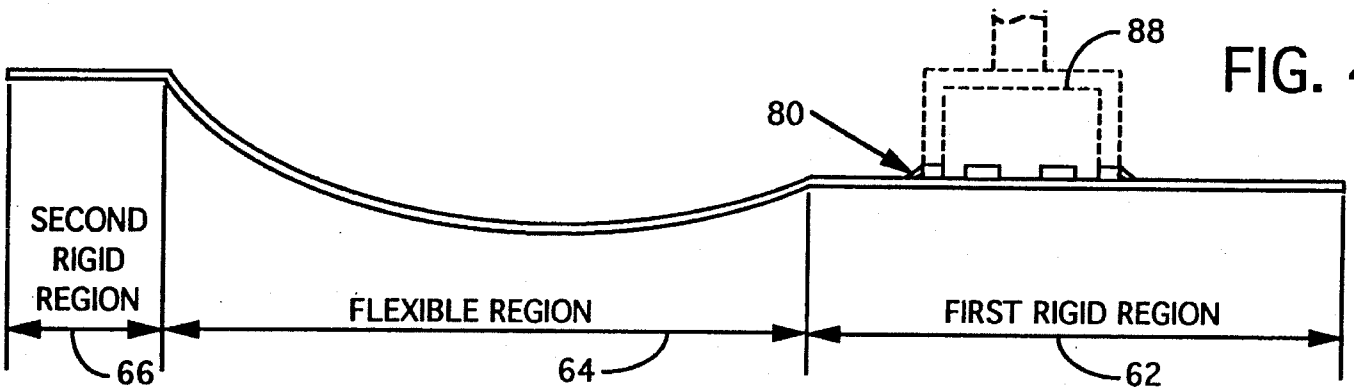
FIG. 3 is a side elevational view of the flexible connector shown in FIG. 2.

As can be seen in FIGS. 2–4, the opening includes a plurality (eight are shown in FIG. 2) of tabs, such as tab 80 that extend radially inwardly from the edge 82 of the opening 68. The tabs are formed by a plurality of radial slits 84. The tabs each have a free edge, such as free edge 86 of tab 80. The free edges define an inner opening 88 having a dimension large enough so that the movable stem 20 can be fit therein. This will be explained in further detail below with respect to FIGS. 5–7.

Initially, the tabs are disposed in a plane that is angularly disposed from the plane containing the first rigid portion 62, as can best be seen in FIGS. 3 and 4. The tabs form a secure interference fit on the movable stem 20 and thus permit current flow directly from the movable stem 20 to the flexible connector 60, as will be discussed in detail with respect to FIGS. 5–7, Referring to FIG. 4, it will be seen that the flexible connector 60 consists of a plurality, in this case eight, flexible sheets of conducting material preferably welded together to form the unified flexible connector 60. Each sheet is approximately 0.127 cm (0.005 inches) in thickness, thus the flexible connector 60 shown in FIG. 4 is about 1,016 cm (0.04 inches) in total thickness. It will be appreciated that each sheet in the stack has a pair of opposed major surfaces with at least a portion of a major surface of one sheet in the stack being in contact with at least a portion of a major surface of an adjacent sheet in the stack. Furthermore, each sheet has a tab, the tab also having a pair of opposed major surfaces with at least a portion of a major surface of one tab in the stack being in contact with at least a portion of a major surface of an adjacent tab in the stack.

Figure 5:
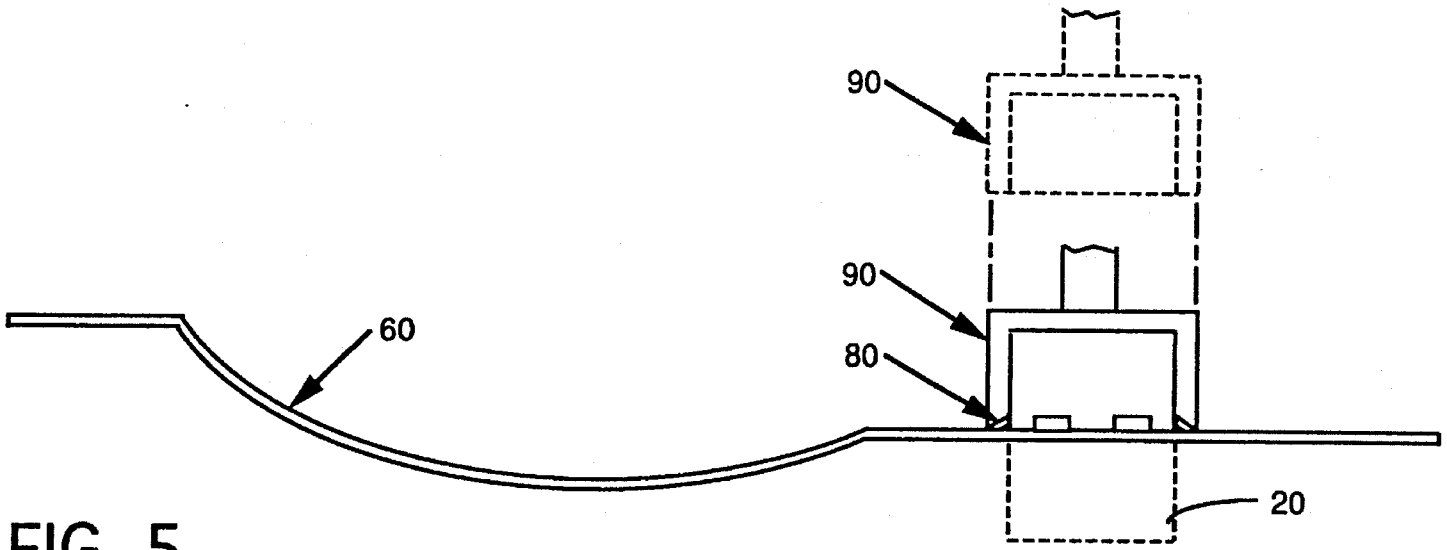
FIG. 5 is a side elevational view showing the movable contact being pressed into the opening in the flexible connector.
Figure 7:
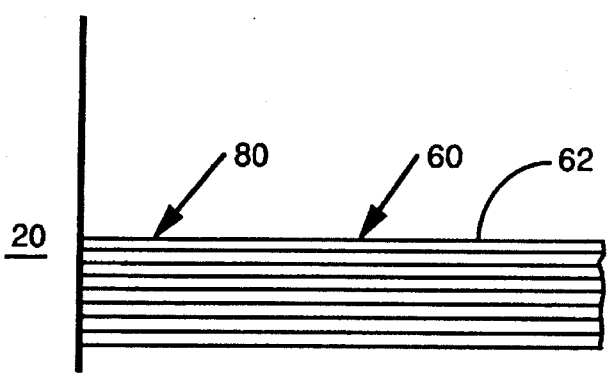
FIG. 7 is an enlarged side elevational view of the tab shown in FIG. 6 after pressing of the movable contact into the opening.
Figure 6:
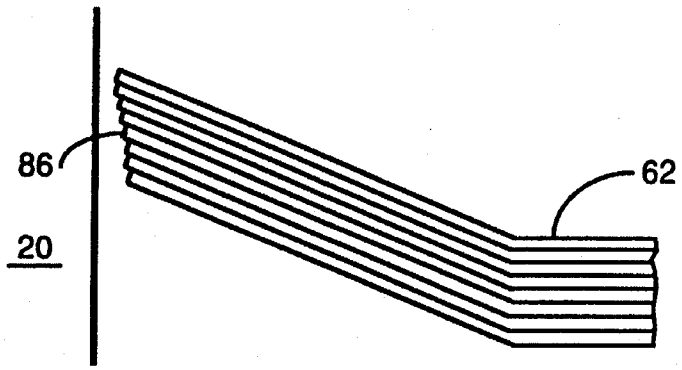
FIG. 6 is an enlarged side elevational view of one of the tabs of the flexible connector before pressing of the movable contact into the opening.

Referring now to FIG. 5, the method of securing the flexible connector 60 to the movable stem 20 will be discussed. As discussed above, the free edges 86 of the tabs 80 form an inner opening 88 large enough for the movable stem 20 to initially be disposed therein as is shown in FIGS. 5 and 6. Once the stem 20 is disposed within the inner opening 88, a press mechanism, such as a pneumatic collar device 90, presses against the tabs 80, so that the tabs 80 form a secure interference fit on the movable stem 20 as is shown in FIG. 7. The tabs 80, after being pressed by the collar device into a secure interference fit with the movable stem 20, are substantially coplanar with the first rigid portion 62 as is shown in FIG. 7. It will be appreciated that at least some, and preferably all of the eight individual flexible sheets in the flexible connector stack directly contact the movable stem 20. This will increase the amount of current that directly flows into the sheets and ultimately to terminal 30, thus enhancing current transfer capability of the movable stem 20 to the flexible connector 60.

It will be appreciated that a flexible connector is provided in which current is transferred directly from the movable stem to the flexible connector. This design not only provides a more direct current flow path, but also drastically lowers the horizontal force on the stem and provides a shorter path for current transfer between the terminal and the stem and thus further limiting the force on the stem.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A circuit interrupter system comprising:

a circuit interrupter including a fixed contact and a movable contact;

a fixed electrical terminal; and a flexible connector for connecting with movable contact to said fixed electrical terminal, said flexible connector defining an opening having an edge, said flexible connector including at least one flexible tab extending inwardly from said edge, said flexible tab being secured in interference fit with said movable contact so that current can flow directly from said movable contact into said flexible connector; said flexible connector being characterized by rigid and flexible portions that permit said flexible connector to move axially with said movable contact.

2. The system of claim 1, wherein said circuit interrupter system is a vacuum circuit interrupter system.

3. The system of claim 1, including a plurality of tabs extending from said edge, said tabs formed by slits in said flexible connector.

4. The system of claim 3, wherein said flexible connector comprises a stack of flexible sheets welded together to form said flexible connector and said tabs being integral with each of said flexible sheets so that at least some of said tabs contact said movable contact.

5. The system of claim 4, wherein a plurality of flexible connectors connecting said movable contact with said fixed electrical terminal; and said flexible connectors being interleaved with spacer plates, said spacer plates each including aligned movable contact openings having edges which contact said movable contact so that said electric current can also flow from said movable contact through said spacer plates and into said flexible connectors.

6. The system of claim 4, wherein each said flexible sheet in said stack has a pair of opposed major surfaces with at least a portion of a major surface of one said flexible sheet in said stack being in contact with at least a portion of a major surface of an adjacent said flexible sheet in said stack.

7. The system of claim 4, wherein each of said flexible sheets in said stack has a tab, said tab having a pair of opposed major surfaces with at least a portion of a major surface of one said tab in said stack being in contact with at least a portion of a major surface of an adjacent said tab in said stack,

8. The system of claim 3, wherein said flexible connector has a first rigid portion which defines said opening and which is in contact with said movable contact, a second rigid portion connected to said fixed electrical terminal and a flexible portion disposed between said first rigid portion and said second rigid portion to permit axial movement of said movable contact with respect to said first rigid portion.

9. The system of claim 8, wherein each of said tabs are disposed in a plane angularly disposed in the plane containing said first rigid portion of said flexible connector before contacting said movable contact; and said tabs are coplanar with said first rigid portion of said flexible connector when said tabs are pressed into said secure interference fit with said movable contact.

10. The system of claim 9, wherein said tabs each having a free edge, said free edges defining an inner opening having a dimension large enough so that said movable contact can be disposed therein; and said free edges are in contact with said movable contact after said tabs are pressed into said secure interference fit with said movable contact.

* * * * *